US009570060B2

(12) United States Patent
Tsunoo

(10) Patent No.: US 9,570,060 B2
(45) Date of Patent: Feb. 14, 2017

(54) TECHNIQUES OF AUDIO FEATURE EXTRACTION AND RELATED PROCESSING APPARATUS, METHOD, AND PROGRAM

(71) Applicant: Sony Corporation, Tokyo (JP)

(72) Inventor: Emiru Tsunoo, Tokyo (JP)

(73) Assignee: Sony Corporation, Tokyo (JP)

( * ) Notice: Subject to any disclaimer, the term of this patent is extended or adjusted under 35 U.S.C. 154(b) by 15 days.

(21) Appl. No.: 14/268,015

(22) Filed: May 2, 2014

(65) Prior Publication Data

US 2014/0337019 A1 Nov. 13, 2014

(30) Foreign Application Priority Data

May 9, 2013 (JP) ..... 2013-099654

(51) Int. Cl.

| | |
|---|---|
| ***G10L 25/54*** | (2013.01) |
| ***G10L 25/03*** | (2013.01) |
| ***G10H 3/12*** | (2006.01) |
| *G10L 25/90* | (2013.01) |

(52) U.S. Cl.

CPC ..... *G10H 3/125* (2013.01); *G10H 2210/056* (2013.01); *G10H 2210/066* (2013.01); *G10L 25/90* (2013.01); *G10L 2025/906* (2013.01)

(58) Field of Classification Search

CPC ..... G10H 3/125; G10H 2210/056; G10H 2201/066; G10L 25/90; G10L 2025/906

USPC ..... 704/205, 207, 209, 211

See application file for complete search history.

(56) References Cited

U.S. PATENT DOCUMENTS

| | | | | |
|---|---|---|---|---|
| 2006/0247922 | A1* | 11/2006 | Hetherington | G10L 21/02 704/208 |
| 2008/0053295 | A1* | 3/2008 | Goto et al. | 84/616 |
| 2012/0065978 | A1* | 3/2012 | Villavicencio | 704/258 |
| 2012/0103167 | A1* | 5/2012 | Saino | G10H 1/0008 84/622 |

OTHER PUBLICATIONS

Goto, M. "A Real-Time Music-Scene-Description System: Predominant-F0 Estimation for Detecting Melody and Bass Lines in Real-World Audio Signals", Speech Communication, Mar. 13, 2004, 311-329, vol. 43, National Institute of Advanced Industrial Science and Technology (AIST), Ibaraki, Japan.

(Continued)

*Primary Examiner* — Thierry L Pham

(74) *Attorney, Agent, or Firm* — Wolf, Greenfield & Sacks, P.C.

(57) ABSTRACT

A music signal processing apparatus includes a frequency spectrum transform unit, a filter, a frequency feature amount generation unit, and a melody feature amount sequence acquisition unit. The frequency spectrum transform unit is configured to transform a music signal into a frequency spectrum, the music signal being a signal of a musical piece containing a part with a melody. The filter is configured to remove a steep peak of the frequency spectrum. The frequency feature amount generation unit is configured to generate, from a signal output from the filter, a frequency feature amount in which a fundamental frequency component of the part is emphasized. The melody feature amount sequence acquisition unit is configured to acquire, based on the frequency feature amount, a melody feature amount sequence that specifies a fundamental frequency of the part at each time.

8 Claims, 7 Drawing Sheets

(56) References Cited

OTHER PUBLICATIONS

Tachibana, H. et al., "Melody Line Estimation in Homophonic Music Audio Signals Based on Temporal-Variability of Melodic Source," ICASSP, Mar. 2010, 425-428, Graduate School of Information Science and Technology, The University of Tokyo, Tokyo, Japan.

* cited by examiner

TECHNIQUES OF AUDIO FEATURE EXTRACTION AND RELATED PROCESSING APPARATUS, METHOD, AND PROGRAM

CROSS REFERENCE TO RELATED APPLICATIONS

This application claims the benefit of Japanese Priority Patent Application JP 2013-099654 filed May 9, 2013, the entire contents of which are incorporated herein by reference.

BACKGROUND

The present disclosure relates to a music signal processing apparatus and method, and a program, and more particularly, to a music signal processing apparatus and method, and a program that are capable of precisely extracting a singing voice without increasing a processing load.

Recently, there has been an increasing demand for search for a melody related to a singing voice from a lot of musical pieces. For example, a humming search to search for a musical piece based on a user's singing voice or humming, a cover song search to search for the original version of a cover-version musical piece, and the like are performed.

As a method of estimating a feature amount of the melody related to the singing voice, i.e., a fundamental frequency of the singing voice, from a voice signal of the musical piece, a method of estimating the feature amount from a maximum peak of a frequency spectrum is proposed (see, for example, M. Goto, "A real-time music-scene-description system: predominant-F0 estimation for detecting melody and bass line in real-world audio signals", Speech Communication (ISCA Journal), Vol. 43, No. 4, pp. 311-329, September, 2004).

Additionally, a method of extracting a singing voice by using pitch fluctuations of the singing voice is also proposed (see, for example, H. Tachibana, T. Ono, N. Ono, S. Sagayama, "Melody line estimation in homophonic music audio signals based on temporal-variability of melodic source", in Proc. of ICASSP 2010, pp. 425-428, March, 2010).

In the technology of "Melody line estimation in homophonic music audio signals based on temporal-variability of melodic source", energy in frequency direction and energy in temporal direction are analyzed to extract the feature amount of the fundamental frequency of the singing voice and the like.

SUMMARY

In the technology of "A real-time music-scene-description system: predominant-F0 estimation for detecting melody and bass line in real-world audio signals", however, in the case where the volume of a melody related to a musical instrument is large, for example, the maximum peak of a frequency spectrum corresponds to a fundamental frequency of the musical instrument, and thus the singing voice is hard to extract precisely.

Further, in the technology of "Melody line estimation in homophonic music audio signals based on temporal-variability of melodic source", it is necessary to analyze a temporally-long voice signal, and a processing load becomes large. Thus, for example, it is difficult to implement the technology in a portable music player and the like.

The present disclosure is disclosed in view of the circumstances as described above, and it is desirable to precisely extract a singing voice without increasing a processing load.

According to an embodiment of the present disclosure, there is provided a music signal processing apparatus including a frequency spectrum transform unit, a filter, a frequency feature amount generation unit, and a melody feature amount sequence acquisition unit. The frequency spectrum transform unit is configured to transform a music signal into a frequency spectrum, the music signal being a signal of a musical piece containing a part with a melody. The filter is configured to remove a steep peak of the frequency spectrum. The frequency feature amount generation unit is configured to generate, from a signal output from the filter, a frequency feature amount in which a fundamental frequency component of the part is emphasized. The melody feature amount sequence acquisition unit is configured to acquire, based on the frequency feature amount, a melody feature amount sequence that specifies a fundamental frequency of the part at each time.

The part may include a singing voice, and the frequency feature amount generation unit may be configured to generate a frequency feature amount in which a fundamental frequency component of the singing voice is emphasized.

The frequency feature amount generation unit may be configured to normalize the signal output from the filter to generate the frequency feature amount in which the fundamental frequency component of the part is emphasized.

The frequency feature amount generation unit may be configured to normalize the signal output from the filter and add a harmonic component to generate the frequency feature amount in which the fundamental frequency component of the part is emphasized.

The melody feature amount sequence acquisition unit may be configured to group the frequency feature amounts in which the fundamental frequency component of the part is emphasized and that are arranged in chronological order, based on a difference absolute value of temporally-adjacent frequency feature amounts, to generate a feature amount sequence candidate, and select the feature amount sequence candidate by dynamic programming to acquire the melody feature amount sequence.

The music signal processing apparatus may further include a pitch trend estimation unit configured to average autocorrelation functions of the frequency feature amounts in which the fundamental frequency component of the part is emphasized, to estimate a pitch trend of the part, in which the melody feature amount sequence acquisition unit may be configured to select the feature amount sequence candidate by dynamic programming and based on the pitch trend to acquire the melody feature amount sequence.

According to another embodiment of the present disclosure, there is provided a music signal processing method including: transforming, by a frequency spectrum transform unit, a music signal into a frequency spectrum, the music signal being a signal of a musical piece containing a part with a melody; removing, by a filter, a steep peak of the frequency spectrum; generating, by a frequency feature amount generation unit, from a signal output from the filter, a frequency feature amount in which a fundamental frequency component of the part is emphasized; and acquiring, by a melody feature amount sequence acquisition unit, based on the frequency feature amount, a melody feature amount sequence that specifies a fundamental frequency of the part at each time.

According to still another embodiment of the present disclosure, there is provided a program causing a computer to function as a music signal processing apparatus including: a frequency spectrum transform unit configured to transform a music signal into a frequency spectrum, the music signal being a signal of a musical piece containing a part with a melody; a filter configured to remove a steep peak of the frequency spectrum; a frequency feature amount generation unit configured to generate, from a signal output from the filter, a frequency feature amount in which a fundamental frequency component of the part is emphasized; and a melody feature amount sequence acquisition unit configured to acquire, based on the frequency feature amount, a melody feature amount sequence that specifies a fundamental frequency of the part at each time.

According to an embodiment of the present disclosure, a music signal being a signal of a musical piece containing a part with a melody is transformed into a frequency spectrum, a steep peak of the frequency spectrum is removed, a frequency feature amount in which a fundamental frequency component of the part is emphasized is generated from a signal output from the filter, and a melody feature amount sequence that specifies a fundamental frequency of the part at each time is acquired based on the frequency feature amount.

According to the present disclosure, it is possible to precisely extract a singing voice without increasing a processing load.

These and other objects, features and advantages of the present disclosure will become more apparent in light of the following detailed description of best mode embodiments thereof, as illustrated in the accompanying drawings.

DETAILED DESCRIPTION OF EMBODIMENTS

Hereinafter, an embodiment of the present disclosure will be described with reference to the drawings.

Figure 1:
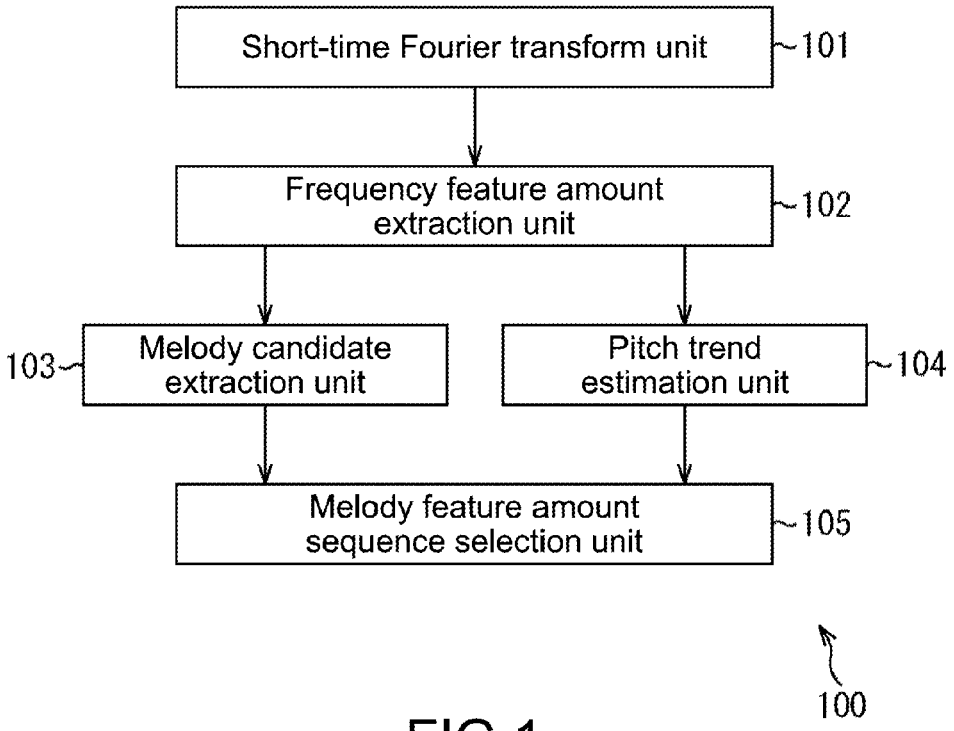
FIG. 1 is a block diagram showing a configuration example of a melody retrieval apparatus according to an embodiment of the present disclosure.

FIG. 1 is a block diagram showing a configuration example of a melody retrieval apparatus according to an embodiment of the present disclosure. A melody retrieval apparatus 100 shown in FIG. 1 acquires information necessary for specifying a melody related to a singing voice in a musical piece (for example, a melody feature amount sequence that will be described later). Here, the musical piece has a configuration including at least one part. For example, it is assumed that the musical piece includes a vocal (singing voice) part, a strings part, a percussion part, and the like.

The melody retrieval apparatus 100 shown in FIG. 1 includes a short-time Fourier transform unit 101, a frequency feature amount extraction unit 102, a melody candidate extraction unit 103, a pitch trend estimation unit 104, and a melody feature amount sequence selection unit 105.

The short-time Fourier transform unit 101 performs Fourier transform on part of a voice signal of a musical piece (hereinafter, referred to as a music signal). At that time, for example, the voice of the musical piece is sampled to generate a music signal, and a frame constituted of the music signals in a period of several hundreds of milliseconds (for example, 200 milliseconds to 300 milliseconds) is subjected to a short-time Fourier transform to generate a frequency spectrum.

The frequency feature amount extraction unit 102 extracts, from the frequency spectrum output from the short-time Fourier transform unit 101, a frequency feature amount that will be described later.

The frequency feature amount extraction unit 102 executes filter processing of removing steep peaks of the frequency spectrum output from the short-time Fourier transform unit 101. For example, the frequency spectrum is caused to pass through a low-pass filter, thus emphasizing gentle peaks of the frequency spectrum.

Figure 2:
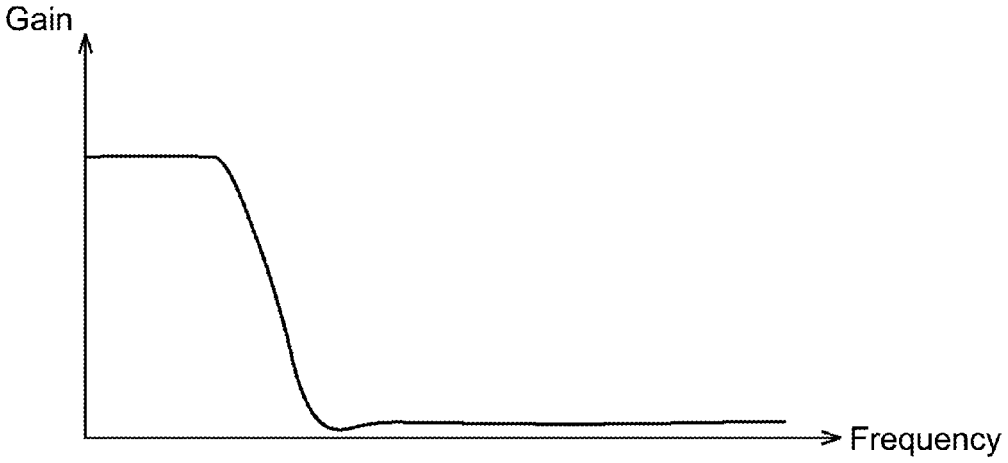
FIG. 2 is a diagram for describing characteristics of a low-pass filter.

At that time, for example, a low-pass filter having characteristics as shown in FIG. 2 is used. In FIG. 2, the horizontal axis represents a frequency ω, and the vertical axis represents a value of a gain by which the music signal is multiplied. As shown in FIG. 2, in the characteristics of the low-pass filter, the gain is low at a frequency higher than a predetermined frequency, and the gain is high at a frequency lower than the predetermined frequency.

For example, in a frequency axis direction of the frequency spectrum, a convolution operation using a low-pass filter such as an FIR (finite impulse response) filter having the characteristics as shown in FIG. 2 is performed. Specifically, an output value l(x,y) of the low-pass filter is expressed by the following formula (1).

$$I(x, y) = \sum_{k=0}^{K-1} a_k \cdot \log|Y(x, y-k)| \tag{1}$$

It should be noted that $a_k$ in the formula (1) represents a filter coefficient and K represents the number of taps of the filter. Additionally, Y(x,y) represents a spectrum value of the frequency spectrum output from the short-time Fourier transform unit 101, x represents a time index, and y represents a frequency index.

The output value l(x,y) obtained as a result of the processing by the formula (1) provides a frequency spectrum from which the steep peaks are removed and in which, for example, a peak corresponding to an instrumental sound is suppressed and a peak corresponding to the singing voice is emphasized.

Further, the frequency feature amount extraction unit 102 normalizes the output value of the low-pass filter by using the following formula (2) and obtains a frequency feature amount p(x,y) in which a component of the singing voice is emphasized. This frequency feature amount represents, so to speak, a probability that the frequency has a peak corresponding to the singing voice.

$$P_v(x, y) = \begin{cases} 1 & \mu(x) < U_Y(x, y) < I(x, y) \\ 0 & U_Y(x, y) \le \mu(x) \\ \dfrac{I(x, y) - \mu(x)}{U_Y(x, y) - \mu(x)} & \text{otherwise} \end{cases} \tag{2}$$

Here, $\mu(x)$ in the formula (2) is a mean value of $\log|Y(x, y)|$, and $U_Y(x,y)$ is a function obtained by connecting the peaks of the $\log|Y(x,y)|$ by a straight line and is shown in the following formula (3).

$$U_Y(x, y) = \frac{(p_+(y) - y)\log|Y(x, p_-(y))| + (y - p_-(y))\log|Y(x, p_+(y))|}{p_+(y) - p_-(y)} \quad (3)$$

Here, $p+(y)$ and $p-(y)$ in the formula (3) are an index of a peak immediately after the frequency index y and an index of a peak immediately before the frequency index y, respectively.

Additionally, the frequency feature amount extraction unit 102 adds a harmonic component to the frequency feature amount obtained as a result of the normalization by the formula (2) to further emphasize the frequency feature amount. At that time, for example, an operation expressed by the following formula (4) is performed, and thus the harmonic component is added and the frequency feature amount is further emphasized.

$$S(x, y) = \frac{\sum_{n=1}^{N} P_v(x, ny) \cdot |Y(x, ny)|}{N^{\alpha}} \quad (4)$$

It should be noted that $\alpha$ in the formula (4) is a parameter, n is an integer of 1 or more, and N is an additional multiple in the frequency index y.

It should be noted that in the case of a stereo sound source, an emphasis using localization information may be performed by, for example, an operation expressed by the following formula (5).

$$S'(x, y) = \frac{\sum_{n=1}^{N} P_v(x, ny) \cdot (|Y_L(x, ny) + Y_R(x, ny)| - |Y_L(x, ny) - Y_R(x, ny)|)}{N^{\alpha}} \quad (5)$$

It should be noted that $Y_L(x,y)$ and $Y_R(x,y)$ in the formula (5) represent a spectrum value of a left channel and a spectrum value of a right channel, respectively.

The processing of the frequency feature amount extraction unit 102 will be further described with reference to FIGS. 3A, 3B, 3C, and 3D.

Figures 3A, 3B, 3C, 3D:
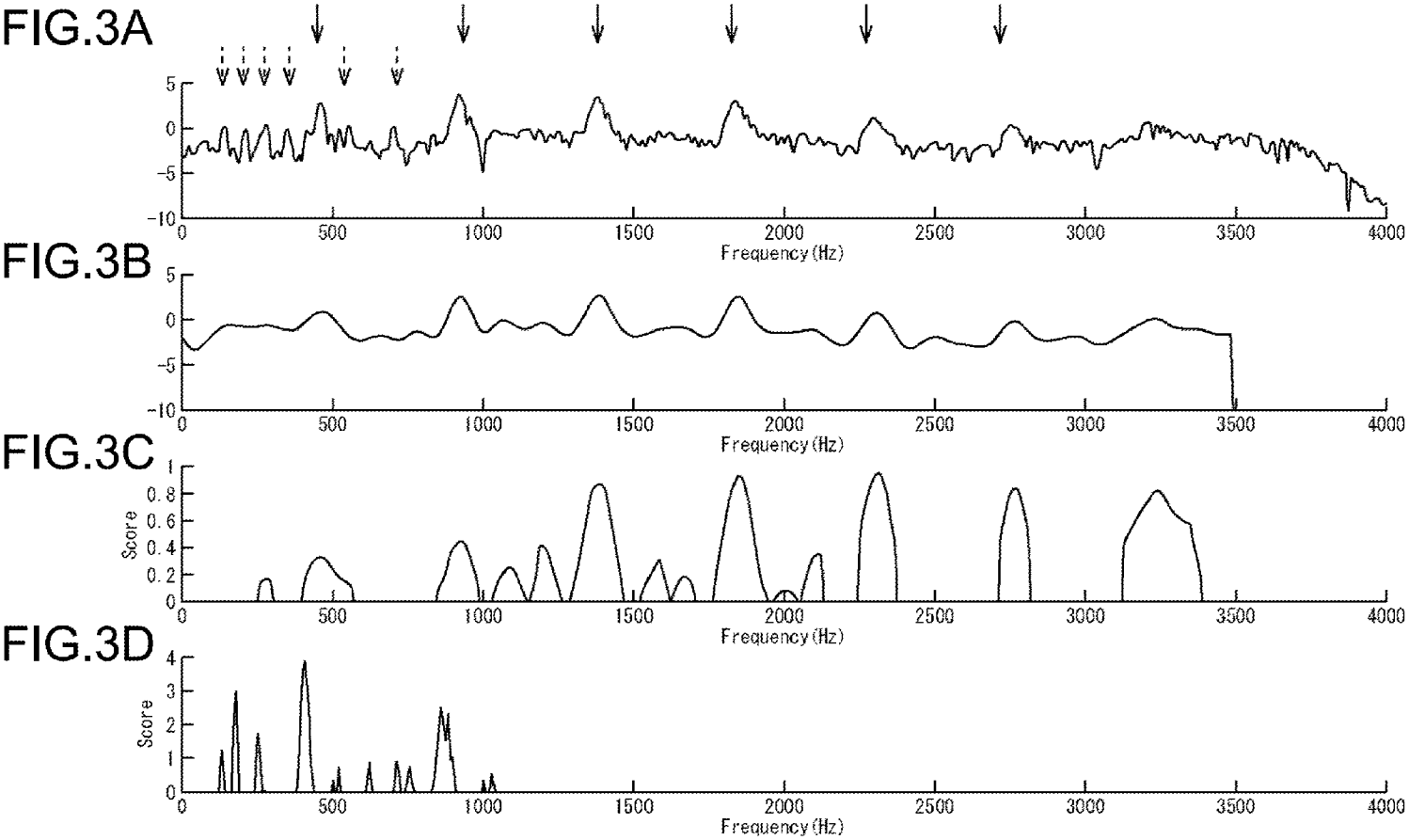
FIGS. 3A, 3B, 3C, and 3D are each a diagram for describing in detail processing of a frequency feature amount extraction unit of FIG. 1.

In FIG. 3A, the horizontal axis represents a frequency and the vertical axis represents power. FIG. 3A shows an example of the frequency spectrum output from the short-time Fourier transform unit 101. In FIG. 3A, peak positions of the frequency spectrum are indicated by arrows of solid lines and dotted lines.

The peaks indicated by the arrows of dotted lines in FIG. 3A are peaks corresponding to instrumental sounds, and six peaks are shown in this example. The peaks indicated by the arrows of solid lines in FIG. 3A are peaks corresponding to the singing voice, and six peaks are shown in this example. It should be noted that a fundamental frequency of the singing voice is one, and thus the other five peaks are due to the harmonic components of the singing voice.

In FIG. 3B, the horizontal axis represents a frequency and the vertical axis represents power. FIG. 3B shows the frequency spectrum that has been subjected to the processing of the low-pass filter. As shown in FIG. 3B, through the processing of the low-pass filter, the steep (pointed) peaks of the frequency spectrum are removed and only gentle peaks are left.

For example, the peaks that are indicated by the arrows of dotted lines in FIG. 3A and correspond to the instrumental sounds are the pointed peaks. This is because the instrumental sounds have a fundamental frequency that is difficult to change over time. Unlike the case of the musical instruments, the singing voice has a fundamental frequency that changes over time. Specifically, the singing voice has characteristics of fluctuating pitches. For that reason, the peaks that are indicated by the arrows of solid lines in FIG. 3A and correspond to the singing voice are gentle peaks.

So, for example, the low-pass filter processing is performed on the frequency spectrum and only the gentle peaks are left as shown in FIG. 3B, so that only the peaks corresponding to the singing voice can be extracted.

As described above, in the embodiment of the present disclosure, the frame constituted of the music signals in the period of several hundreds of milliseconds (for example, 200 milliseconds to 300 milliseconds) is subjected to the short-time Fourier transform. For example, in the case where the period of the music signals of the frame used in the short-time Fourier transform is shorter, the frequency spectrum related to the singing voice also has steep peaks. In the embodiment of the present disclosure, obtained is a frequency spectrum having gentle peaks corresponding to the fluctuation of pitches of the singing voice, which has a fundamental frequency that changes over time.

In FIG. 3C, the horizontal axis represents a frequency and the vertical axis represents power. FIG. 3C shows a frequency feature amount that is obtained by the normalization and in which a component of the singing voice is emphasized. As shown in FIG. 3C, the peaks extracted as peaks corresponding to the singing voice in FIG. 3B are further emphasized.

In FIG. 3D, the horizontal axis represents a frequency and the vertical axis represents power. FIG. 3D shows a frequency feature amount to which the harmonic component is added and in which a fundamental frequency component is further emphasized.

Referring back to FIG. 1, the melody candidate extraction unit 103 arranges in chronological order the frequency feature amounts that are obtained through the processing by the frequency feature amount extraction unit 102 and in which the singing voice is emphasized as shown in FIG. 3D. For example, assuming that a depth direction of the plane of FIG. 3D is a time axis, the frequency feature amounts in which the singing voice is emphasized as shown in FIG. 3D are arranged in the depth direction of the plane. For example, a frequency feature amount in which the singing voice at time t1 is emphasized, a frequency feature amount in which the singing voice at time t2 is emphasized, a frequency feature amount in which the singing voice at time t3 is emphasized, and so on are arranged in the depth direction of the plane.

Subsequently, the emphasized frequency feature at the respective times, which are frequencies corresponding to the peaks shown in FIG. 3D, are plotted as frequency feature amounts. For example, in a two-dimensional space in which the horizontal axis represents a time and the vertical axis represents a frequency, the frequency feature amounts are plotted in chronological order.

The melody candidate extraction unit 103 further groups the plotted frequency feature amounts to generate a feature amount sequence candidate.

Figure 4:
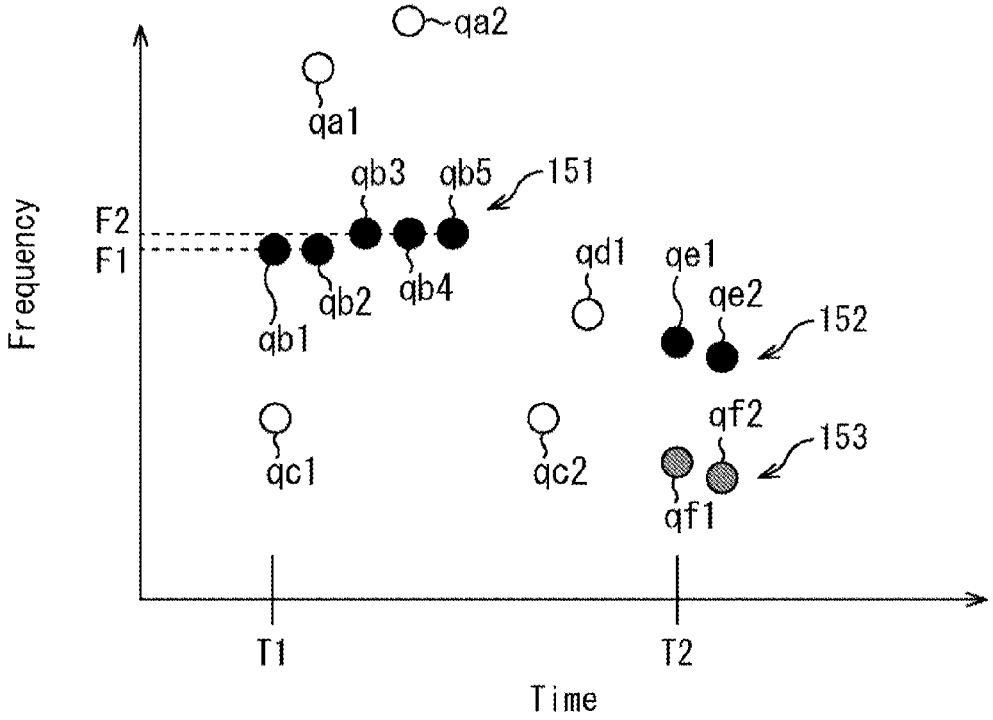
FIG. 4 is a diagram showing an example of frequency feature amounts plotted in chronological order in a two-dimensional space.

FIG. 4 is a diagram showing an example of the frequency feature amounts plotted in chronological order in the two-dimensional space in which the horizontal axis represents a time and the vertical axis represents a frequency. In FIG. 4, each of the plotted frequency feature amounts is represented as a circle.

For example, at the leftmost (earliest) time in FIG. 4, a frequency feature amount qb1 and a frequency feature amount qc1 are plotted. At the subsequent time, a frequency feature amount qa1 and a frequency feature amount qb2 are plotted. At the subsequent time, a frequency feature amount qb3 is plotted. At the further subsequent time, a frequency feature amount qa2 and a frequency feature amount qb4 are plotted. In such a manner, each frequency feature amount is plotted.

The melody candidate extraction unit 103 calculates absolute values of differences (hereinafter, referred to as difference absolute value) between temporally-adjacent frequency feature amounts (in this case, frequency values) and groups the frequency feature amounts whose obtained difference absolute values are less than a preset threshold (for example, semitone).

For example, since a difference absolute value of the frequency feature amount qb1 and the frequency feature amount qb2 that is temporally adjacent to the frequency feature amount qb1 is less than the threshold, the frequency feature amount qb1 and the frequency feature amount qb2 belong to the same group. Meanwhile, a difference absolute value of the frequency feature amount qb1 and the frequency feature amount qa1 that is temporally adjacent to the frequency feature amount qb1 is equal to or larger than the threshold, and thus the frequency feature amount qb1 and the frequency feature amount qa1 do not belong to the same group.

As a result of the grouping of the frequency feature amounts in such a manner, a feature amount sequence candidate 151 is generated. The feature amount sequence candidate 151 is constituted of the frequency feature amount qb1 to a frequency feature amount qb5 that are five temporally-successive frequency feature amounts and indicated by black circles in FIG. 4. In the same manner, a feature amount sequence candidate 152 constituted of a frequency feature amount qe1 and a frequency feature amount qe2 indicated by black circles in FIG. 4 is generated, and a feature amount sequence candidate 153 constituted of a frequency feature amount qf1 and a frequency feature amount qf2 indicated by circles with hatching in FIG. 4 is generated.

Referring back to FIG. 1, the pitch trend estimation unit 104 estimates a pitch trend of the singing voice. The pitch trend represents a tendency of a change in frequency feature amount due to a lapse of time. In the above case, the pitch trend is estimated based on, for example, a frequency feature amount whose frequency resolution and time resolution are rough and in which the singing voice is emphasized. For example, the pitch trend is estimated by averaging autocorrelation functions of the frequency feature amount.

In the following formula (6), an example in which a pitch trend T(x) is obtained by averaging the autocorrelation functions of the frequency feature amount is shown.

$$T(x) = \underset{y}{\operatorname{argmax}} \frac{1}{IJ} \sum_{i=x-I/2}^{x+I/2} \sum_{j=y-I/2}^{x+J/2} \left( \sum_{a} p_v(i, j) p_v(i, j-a) \right) \tag{6}$$

It should be noted that in the formula (6), I and J represent a magnitude at which averaging in a time axis direction is performed and a magnitude at which averaging in a frequency axis direction is performed, respectively.

The melody feature amount sequence selection unit 105 selects the feature amount sequence candidate extracted by the melody candidate extraction unit 103 based on the pitch trend estimated by the pitch trend estimation unit 104 to specify a melody feature amount sequence. For example, using a difference absolute value in frequency between the feature amount sequence candidate and the pitch trend, a difference absolute value in frequency between the feature amount sequence candidates, and the frequency feature amounts of the respective feature amount sequence candidates, a feature amount candidate by which $D_M$ of the following formula (7) is maximized is selected by dynamic programming.

$$D_M = \sum_{m} \left( \sum_{x,y \in C_m} S(x, y) - \gamma_1 \sum_{x,y \in C_m} |\log y - \log T(x)| - \gamma_2 |\log y_{m-1,last} - \log y_{m,first}| \right) \tag{7}$$

It should be noted that in the formula (7), γ1 and γ2 are parameters and C represents the feature amount sequence candidate.

Figure 5:
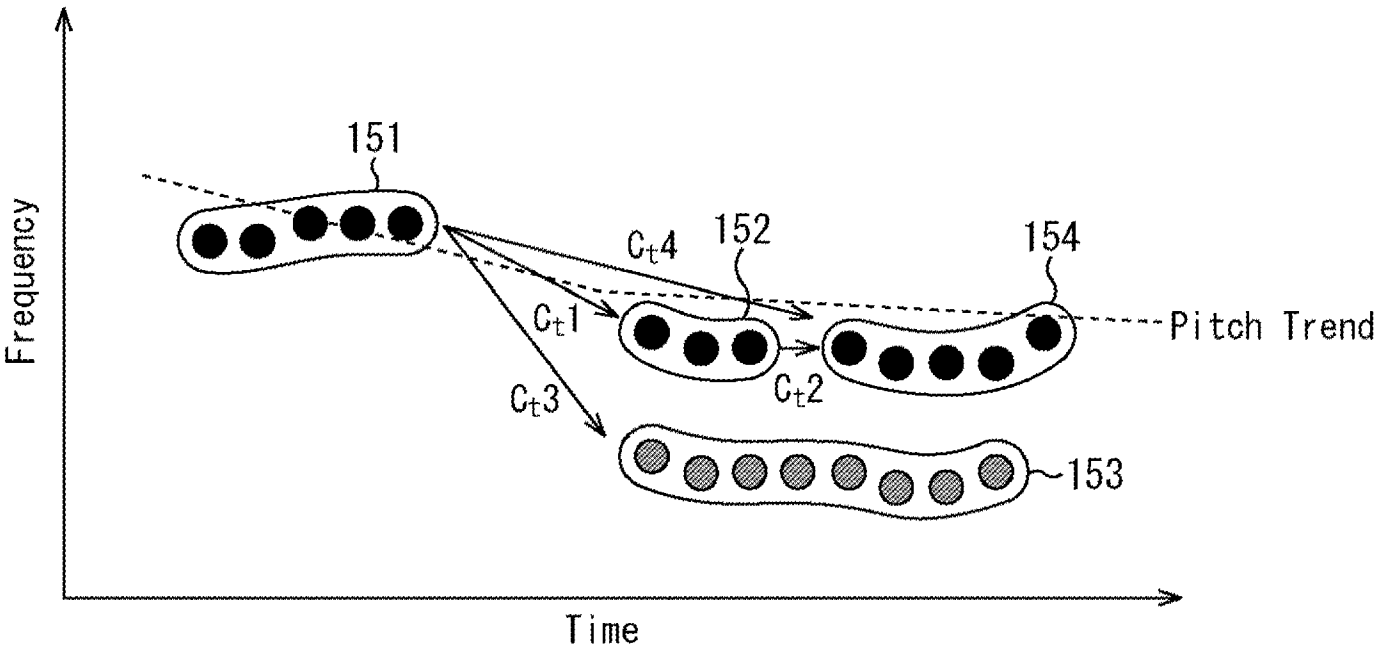
FIG. 5 is a diagram for describing a specific scheme of a melody feature amount sequence.

Consequently, for example, as shown in FIG. 5, the feature amount sequence candidate is selected in chronological order so as to minimize a transition cost.

FIG. 5 is a diagram showing an example of the frequency feature amounts plotted in chronological order in the two-dimensional space in which the horizontal axis represents a time and the vertical axis represents a frequency as in FIG. 4. It is assumed that in the example of FIG. 5, the feature amount sequence candidate 151 to the feature amount sequence candidate 154 are already generated by the melody candidate extraction unit 103 and a pitch trend indicated by a dotted line of FIG. 5 is already estimated by the pitch trend estimation unit 104.

In this case, the transition cost from the feature amount sequence candidate 151 to each of the feature amount sequence candidates 152, 153, and 154 is calculated. Specifically, the transition cost from the temporally-earliest feature amount sequence candidate 151 to each of the feature amount sequence candidates, which are temporally-posterior to the feature amount sequence candidate 151, is calculated. It should be noted that the transition cost is a value calculated by the third term of the formula (7).

The transition cost to the feature amount sequence candidate 152 is denoted by $C_t1$, the transition cost to the feature amount sequence candidate 153 is denoted by $C_t3$, and the transition cost to the feature amount sequence candidate 154 is denoted by $C_t4$.

In such a case, all the transition costs are calculated. Specifically, the transition cost $C_t1$ in a transition to the feature amount sequence candidate 152, the transition costs $C_t1$ and $C_t2$ in a transition to the feature amount sequence candidate 154 through the feature amount sequence candidate 152, the transition cost $C_t4$ in a direct transition to the feature amount sequence candidate 154, and the transition cost $C_t3$ in a transition to the feature amount sequence candidate 153 are calculated, the feature amount sequence candidate 152, the feature amount sequence candidate 154, and the feature amount sequence candidate 153 each serving as a transition destination from the feature amount sequence candidate 151. Subsequently, the feature amount sequence candidate 152 and the feature amount sequence candidate 154 are selected as candidates that maximize $D_M$ of the formula (7).

This allows the frequency feature amount group, which is constituted of the feature amount sequence candidate 151, the feature amount sequence candidate 152, and the feature amount sequence candidate 154, to be specified as a melody feature amount sequence. The candidates of the melody feature amount sequence are specified, and thus the fundamental frequency of the singing voice at each time is specified.

Using the melody feature amount sequence thus obtained, the melody of the singing voice can be correctly recognized.

In the above example, the melody feature amount sequence selection unit 105 selects the feature amount sequence candidates based on the pitch trend to specify the melody feature amount sequence. However, for example, the feature amount sequence candidates may be selected using a predetermined value instead of using the pitch trend. Specifically, the pitch trend estimation unit 104 may not be provided.

Figure 6:
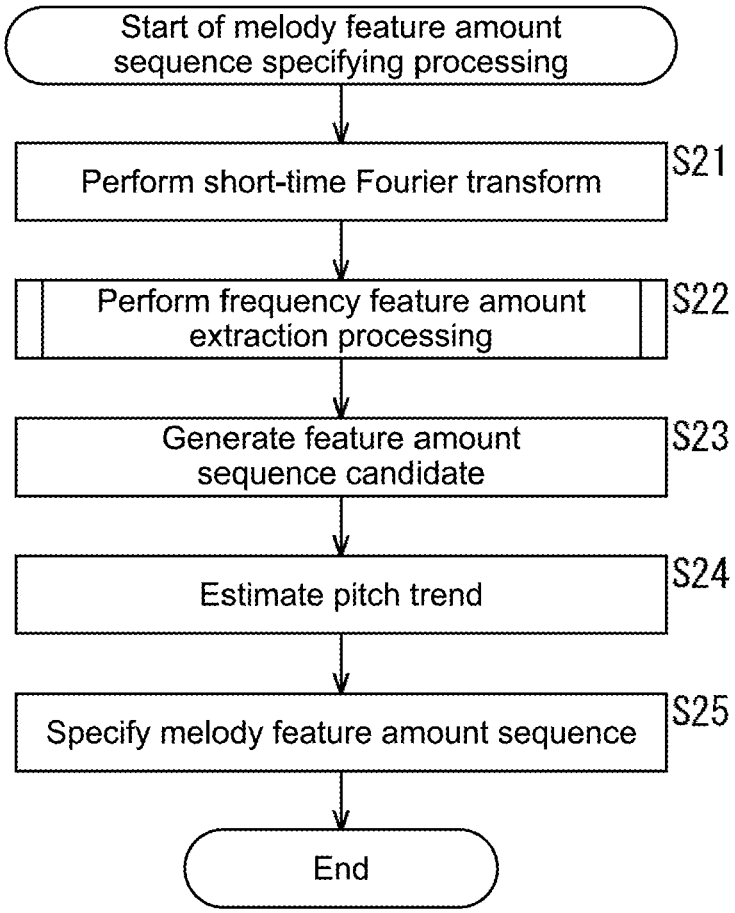
FIG. 6 is a flowchart for describing an example of melody feature amount sequence specifying processing.

Next, the example of the melody feature amount sequence specifying processing by the melody retrieval apparatus 100 according to the embodiment of the present disclosure will be described with reference to a flowchart of FIG. 6.

In S21, the short-time Fourier transform unit 101 performs Fourier transform on part of a music signal of a musical piece. At that time, for example, the voice of the musical piece is sampled to generate a music signal, and a frame constituted of the music signals in a period of several hundreds of milliseconds (for example, 200 milliseconds to 300 milliseconds) is subjected to a short-time Fourier transform to generate a frequency spectrum.

Figure 7:
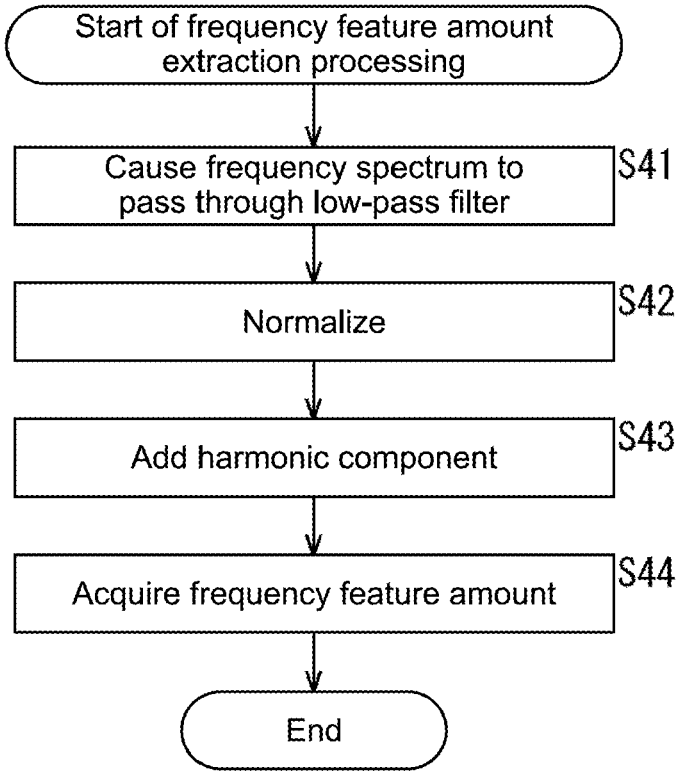
FIG. 7 is a flowchart for describing a detailed example of frequency feature amount extraction processing.

In S22, the frequency feature amount extraction unit 102 executes frequency feature amount extraction processing that will be described later with reference to a flowchart of FIG. 7. Thus, a frequency feature amount is extracted from the frequency spectrum output from the short-time Fourier transform unit 101.

In S23, the melody candidate extraction unit 103 generates a feature amount sequence candidate. At that time, for example, the melody candidate extraction unit 103 arranges the frequency feature amounts in chronological order to be plotted. The frequency feature amounts are obtained through the processing by the frequency feature amount extraction unit 102 and emphasized as shown in FIG. 3D. Subsequently, the melody candidate extraction unit 103 calculates a difference absolute value of the temporally-adjacent frequency feature amounts (in this case, frequency values) and groups the frequency feature amounts whose obtained difference absolute values are less than a preset threshold (for example, semitone).

In Step S24, the pitch trend estimation unit 104 estimates a pitch trend. At that time, for example, as expressed in the formula (6), the pitch trend is estimated by averaging autocorrelation functions of the frequency feature amount.

In Step S25, the melody feature amount sequence selection unit 105 selects the feature amount sequence candidate generated in Step S23 based on the pitch trend estimated in Step S24 to specify a melody feature amount sequence. At that time, for example, using a difference absolute value in frequency between the feature amount sequence candidate and the pitch trend, a difference absolute value in frequency between the feature amount sequence candidates, and the frequency feature amounts of the respective feature amount sequence candidates, a feature amount candidate by which $D_M$ of the formula (7) is maximized is selected by dynamic programming.

In such a manner, the melody feature amount sequence is specified.

Next, the detailed example of the frequency feature amount extraction processing of Step S22 of FIG. 6 will be described with reference to the flowchart of FIG. 7.

In Step S41, the frequency feature amount extraction unit 102 causes the frequency spectrum obtained as a result of the processing of Step S21 to pass through the low-pass filter. At that time, for example, the convolution operation described above with reference to the formula (1) is performed, thus emphasizing the gentle peaks of the frequency spectrum.

In Step S42, the frequency feature amount extraction unit 102 normalizes, by using the formula (2), the output value of the low-pass filter obtained by the processing of Step S41 and obtains a frequency feature amount in which a component of the singing voice is emphasized.

In Step S43, the frequency feature amount extraction unit 102 adds a harmonic component to the frequency feature amount that is obtained as a result of the processing of Step S42 and in which the component of the singing voice is emphasized. At that time, for example, the operation expressed by the formula (4) is performed, and thus the harmonic component is added.

It should be noted that in the case of a stereo sound source, an emphasis using localization information may be performed by, for example, the operation expressed by the formula (5).

In Step S44, the frequency feature amount extraction unit 102 acquires the frequency feature amount as shown in FIG. 3D, for example.

In such a manner, the frequency feature amount extraction processing is executed.

In the above description, the melody retrieval apparatus 100 to which an embodiment of the present disclosure is applied acquires the information necessary for specifying a melody related to a singing voice in a musical piece. However, the melody related to the singing voice is not necessarily specified. For example, the melody retrieval apparatus 100 to which an embodiment of the present disclosure may be used for acquiring information necessary for specifying a melody related to a musical instrument (such as a violin) having characteristics of fluctuating pitches, as in the singing voice.

It should be noted that the series of processing described above may be executed by hardware or software. In the case where the series of processing described above is executed by software, programs constituting the software are installed from a network or a recording medium in a computer incorporated in dedicated hardware or in a general-purpose personal computer 700 as shown in, for example, FIG. 8, which is capable of executing various functions by installing various programs.

Figure 8:
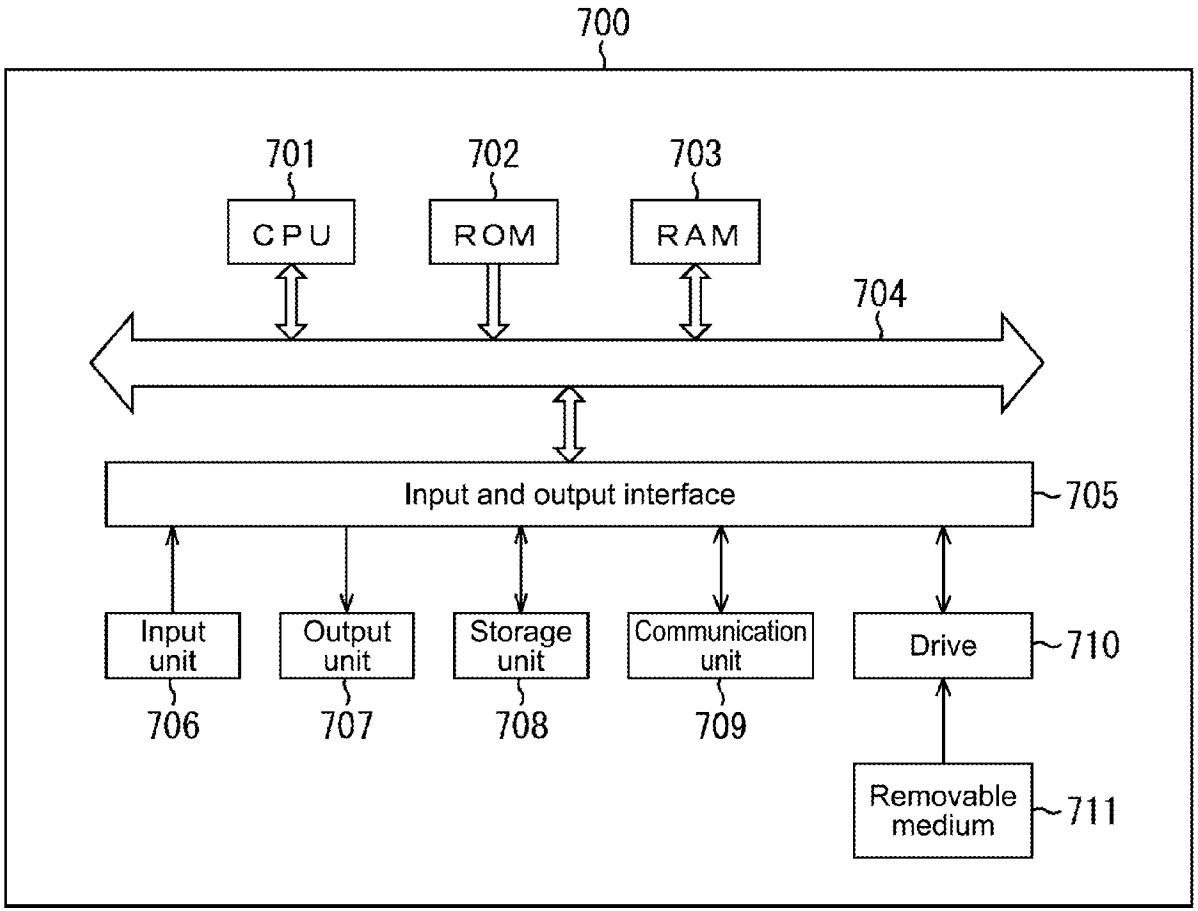
FIG. 8 is a block diagram showing a configuration example of a personal computer.

In FIG. 8, a CPU (Central Processing Unit) 701 executes various types of processing according to programs stored in a ROM (Read Only Memory) 702 or programs loaded from a storage unit 708 to a RAM (Random Access Memory) 703. The RAM 703 also stores data necessary for the CPU 701 to execute various types of processing as appropriate.

The CPU 701, the ROM 702, and the RAM 703 are connected to one another via a bus 704. The bus 704 is also connected to an input and output interface 705.

The input and output interface 705 is connected to an input unit 706, an output unit 707, the storage unit 708, and a communication unit 709. The input unit 706 includes a keyboard and a mouse. The output unit 707 includes a display such as an LCD (Liquid Crystal display) and a speaker. The storage unit 708 includes a hard disk and the like. The communication unit 709 includes a modem and a network interface card such as a LAN (Local Area Network) card. The communication unit 709 performs communication processing via a network including the Internet.

The input and output interface 705 is also connected to a drive 710 as necessary. A removable medium 711 such as a magnetic disc, an optical disc, a magneto-optical disc, and a semiconductor memory is appropriately mounted to the drive 710, and a computer program read from the removable medium 711 is installed in the storage unit 708 as necessary.

In the case where the series of processing described above is executed by software, programs constituting the software are installed from a network such as the Internet or a recording medium such as the removable medium 711.

The recording medium is not limited to a recording medium constituted of the removable medium 711 as shown in FIG. 8, which is provided separate from a main body of the apparatus and distributed to deliver programs to a user. The removable medium 711 includes a magnetic disc (including a floppy disk (registered trademark)), an optical disc (including a CD-ROM (Compact Disk-Read Only Memory) and a DVD (Digital Versatile Disk)), a magneto-optical disc (including an MD (Mini-Disk) (registered trademark)), or a semiconductor memory, which stores programs. The recording medium may also include a recording medium constituted of the ROM 702 or a hard disk included in the storage unit 708, which stores programs distributed to a user in a state of being built in the main body of the apparatus.

The series of processing described above in this specification include, in addition to processing that are performed chronologically along the described order, processing that are executed in parallel or individually though not necessarily processed chronologically.

Further, the embodiment of the present disclosure is not limited to the embodiment described above and can be variously modified without departing from the gist of the present disclosure.

It should be noted that the present disclosure can have the following configurations.

(1) A music signal processing apparatus, including:

a frequency spectrum transform unit configured to transform a music signal into a frequency spectrum, the music signal being a signal of a musical piece containing a part with a melody;

a filter configured to remove a steep peak of the frequency spectrum;

a frequency feature amount generation unit configured to generate, from a signal output from the filter, a frequency feature amount in which a fundamental frequency component of the part is emphasized; and a melody feature amount sequence acquisition unit configured to acquire, based on the frequency feature amount, a melody feature amount sequence that specifies a fundamental frequency of the part at each time.

(2) The music signal processing apparatus according to (1), in which the part includes a singing voice, and the frequency feature amount generation unit is configured to generate a frequency feature amount in which a fundamental frequency component of the singing voice is emphasized.

(3) The music signal processing apparatus according to (1) or (2), in which the frequency feature amount generation unit is configured to normalize the signal output from the filter to generate the frequency feature amount in which the fundamental frequency component of the part is emphasized.

(4) The music signal processing apparatus according to (3), in which the frequency feature amount generation unit is configured to normalize the signal output from the filter and add a harmonic component to generate the frequency feature amount in which the fundamental frequency component of the part is emphasized.

(5) The music signal processing apparatus according to any one of (1) to (4), in which the melody feature amount sequence acquisition unit is configured to group the frequency feature amounts in which the fundamental frequency component of the part is emphasized and that are arranged in chronological order, based on a difference absolute value of temporally-adjacent frequency feature amounts, to generate a feature amount sequence candidate, and select the feature amount sequence candidate by dynamic programming to acquire the melody feature amount sequence.

(6) The music signal processing apparatus according to any one of (1) to (5), further including a pitch trend estimation unit configured to average autocorrelation functions of the frequency feature amounts in which the fundamental frequency component of the part is emphasized, to estimate a pitch trend of the part, in which the melody feature amount sequence acquisition unit is configured to select the feature amount sequence candidate by dynamic programming and based on the pitch trend to acquire the melody feature amount sequence.

(7) A music signal processing method, including:

transforming, by a frequency spectrum transform unit, a music signal into a frequency spectrum, the music signal being a signal of a musical piece containing a part with a melody;

removing, by a filter, a steep peak of the frequency spectrum;

generating, by a frequency feature amount generation unit, from a signal output from the filter, a frequency feature amount in which a fundamental frequency component of the part is emphasized; and acquiring, by a melody feature amount sequence acquisition unit, based on the frequency feature amount, a melody feature amount sequence that specifies a fundamental frequency of the part at each time.

(8) A program causing a computer to function as a music signal processing apparatus including:

a frequency spectrum transform unit configured to transform a music signal into a frequency spectrum, the music signal being a signal of a musical piece containing a part with a melody;

a filter configured to remove a steep peak of the frequency spectrum;

a frequency feature amount generation unit configured to generate, from a signal output from the filter, a frequency feature amount in which a fundamental frequency component of the part is emphasized; and a melody feature amount sequence acquisition unit configured to acquire, based on the frequency feature amount, a melody feature amount sequence that specifies a fundamental frequency of the part at each time.

It should be understood by those skilled in the art that various modifications, combinations, sub-combinations and alterations may occur depending on design requirements and other factors insofar as they are within the scope of the appended claims or the equivalents thereof.

What is claimed is:

1. A music signal processing apparatus, comprising:

a frequency spectrum transform circuit configured to transform a music signal into a frequency spectrum, the music signal being a signal of a musical piece containing a plurality of parts, the plurality of parts including a first part with a melody, wherein the frequency spectrum indicates a power of the music signal at each of a plurality of frequency values;

a filter circuit configured to remove a steep peak of the frequency spectrum, thereby producing a second frequency spectrum that indicates power at at least two frequency values of the plurality of frequency values;

a frequency feature amount generation circuit configured to generate, from the second frequency spectrum output from the filter, a frequency feature amount that indicates frequencies from amongst the at least two frequency values in which one or more fundamental frequency components of parts of the plurality of parts are emphasized; and a melody feature amount sequence acquisition circuit configured to identify the first part amongst the plurality of parts by producing, based on a plurality of frequency feature amounts generated by the frequency feature amount generation circuit, at least one melody feature amount sequence that specifies a fundamental frequency of the first part at a plurality of different times.

2. The music signal processing apparatus according to claim 1, wherein the first part includes a singing voice, and the frequency feature amount generation circuit is configured to generate a frequency feature amount in which a fundamental frequency component of the singing voice is emphasized.

3. The music signal processing apparatus according to claim 1, wherein the frequency feature amount generation circuit is configured to normalize the second frequency spectrum output from the filter to generate the frequency feature amount in which the one or more fundamental frequency components of parts of the plurality of parts are emphasized.

4. The music signal processing apparatus according to claim 3, wherein the frequency feature amount generation circuit is configured to normalize the second frequency spectrum output from the filter and add a harmonic component to generate the frequency feature amount in which the one or more fundamental frequency components of parts of the plurality of parts are emphasized.

5. The music signal processing apparatus according to claim 1, wherein the melody feature amount sequence acquisition circuit is configured to group the frequency feature amounts in which the one or more fundamental frequency components of parts of the plurality of parts are emphasized and that are arranged in chronological order, based on a difference absolute value of temporally-adjacent frequency feature amounts, to generate a feature amount sequence candidate, and select the feature amount sequence candidate by dynamic programming to acquire the melody feature amount sequence.

6. The music signal processing apparatus according to claim 1, further comprising a pitch trend estimation circuit configured to average autocorrelation functions of the frequency feature amounts in which the one or more fundamental frequency components of parts of the plurality of parts are emphasized, to estimate a pitch trend of the part, wherein the melody feature amount sequence acquisition circuit is configured to select a feature amount sequence candidate by dynamic programming and based on the pitch trend to acquire the melody feature amount sequence.

7. A music signal processing method, comprising:

transforming, by a frequency spectrum transform circuit, a music signal into a frequency spectrum, the music signal being a signal of a musical piece containing a plurality of parts, the plurality of parts including a first part with a melody, wherein the frequency spectrum indicates a power of the music signal at each of a plurality of frequency values;

removing, by a filter circuit, a steep peak of the frequency spectrum, thereby producing a second frequency spectrum that indicates power at at least two frequency values of the plurality of frequency values;

generating, by a frequency feature amount generation circuit, from the second frequency spectrum output from the filter, a frequency feature amount that indicates frequencies from amongst the at least two frequency values in which one or more fundamental frequency components of parts of the plurality of parts are emphasized; and identifying the first part amongst the plurality of parts by producing, by a melody feature amount sequence acquisition circuit, based on a plurality of frequency feature amounts generated by the frequency feature amount generation circuit, at least one melody feature amount sequence that specifies a fundamental frequency of the first part at a plurality of different times.

8. At least one non-transitory computer readable medium comprising instructions that, when executed by at least one computer, cause the at least one computer to perform a method, comprising:

transforming a music signal into a frequency spectrum, the music signal being a signal of a musical piece containing a plurality of parts, the plurality of parts including a first part with a melody, wherein the frequency spectrum indicates a power of the music signal at each of a plurality of frequency values;

removing a steep peak of the frequency spectrum, thereby producing a second frequency spectrum that indicates power at at least two frequency values of the plurality of frequency values;

generating, from the second frequency spectrum output from the filter, a frequency feature amount that indicates frequencies from amongst the at least two frequency values in which one or more fundamental frequency components of parts of the plurality of parts are emphasized; and identifying the first part amongst the plurality of parts by producing, based on a plurality of generated frequency feature amounts, at least one melody feature amount sequence that specifies a fundamental frequency of the first part at a plurality of different times.

* * * * *